US011470711B2

(12) United States Patent
Jindo

(10) Patent No.: US 11,470,711 B2
(45) Date of Patent: Oct. 11, 2022

(54) PLASMA GENERATOR WITH CONNECTOR-CABLE DETECTOR

(71) Applicant: FUJI CORPORATION, Chiryu (JP)

(72) Inventor: Takahiro Jindo, Anjo (JP)

(73) Assignee: FUJI CORPORATION, Chiryu (JP)

( * ) Notice: Subject to any disclaimer, the term of this patent is extended or adjusted under 35 U.S.C. 154(b) by 459 days.

(21) Appl. No.: 16/610,166

(22) PCT Filed: May 16, 2017

(86) PCT No.: PCT/JP2017/018304

§ 371 (c)(1),
(2) Date: Nov. 1, 2019

(87) PCT Pub. No.: WO2018/211585

PCT Pub. Date: Nov. 22, 2018

(65) Prior Publication Data

US 2021/0176852 A1 Jun. 10, 2021

(51) Int. Cl.

| | |
|---|---|
| ***H05H 1/34*** | (2006.01) |
| ***H01B 7/00*** | (2006.01) |
| ***H01R 43/26*** | (2006.01) |

(52) U.S. Cl.

CPC ..... *H05H 1/34* (2013.01); *H01B 7/0045* (2013.01); *H01R 43/26* (2013.01); *H05H 1/3478* (2021.05)

(58) Field of Classification Search

None

See application file for complete search history.

(56) References Cited

U.S. PATENT DOCUMENTS 3,604,889 A * 9/1971 Rohrberg ..... H05H 1/26 219/121.45
3,912,889 A * 10/1975 Bright ..... H01R 13/641 439/944
5,272,477 A * 12/1993 Tashima ..... G05D 23/1917 340/12.54

(Continued)

FOREIGN PATENT DOCUMENTS

CN 101563619 A 10/2009
CN 107969063 A * 4/2018 ..... H05H 1/34

(Continued)

OTHER PUBLICATIONS

International Search Report dated Aug. 15, 2017 in PCT/JP2017/018304 filed on May 16, 2017.

*Primary Examiner* — Timothy J. Dole
*Assistant Examiner* — Muhammed Azam
(74) *Attorney, Agent, or Firm* — Oblon, McClelland, Maier & Neustadt, L.L.P.

(57) ABSTRACT

A plasma generator that detects whether a connector of a head is electrically connected to a power cable. The plasma generator includes the head including the connector with a terminal to supply electricity to electrodes that generate plasma by electrical discharge, and a first terminal and a second terminal that are connected to each other; a power cable to supply electricity to the terminal; a cable to transmit a signal to the first terminal; a first ground cable to ground the second terminal; and a detector to detect a signal current that flows in a path from the cable to the first ground cable in accordance with transmission of the signal.

6 Claims, 5 Drawing Sheets

(56) References Cited

U.S. PATENT DOCUMENTS 5,525,795 A * 6/1996 MacGregor ..... H01R 13/641 361/801
5,796,067 A * 8/1998 Enyedy ..... B23K 10/00 219/121.52
5,807,130 A * 9/1998 Miller ..... H01R 13/4364 439/352
5,971,591 A * 10/1999 Vona ..... H01J 37/32935 219/121.54
6,017,236 A * 1/2000 Yoshida ..... H01R 13/62905 439/489
6,794,601 B2 * 9/2004 Norris ..... H05H 1/36 219/121.57
6,903,301 B2 * 6/2005 Jones ..... H05H 1/34 219/121.52
7,312,963 B1 * 12/2007 Radosavljevic ..... H01R 13/641 361/115
9,170,295 B2 * 10/2015 Choi ..... G01R 19/0061
10,431,437 B2 * 10/2019 Gapi 70nski ..... H01J 37/32944
2002/0139782 A1 * 10/2002 Onitsuka ..... H05H 1/3423 219/121.48
2003/0043516 A1 * 3/2003 Ahlstrom ..... B23K 9/10 361/48
2003/0087548 A1 * 5/2003 Katsuma ..... H01R 13/641 439/489
2003/0100208 A1 * 5/2003 Conway ..... H05H 1/34 439/191
2009/0167286 A1 * 7/2009 Naylor ..... G01R 31/58 324/66
2012/0058649 A1 * 3/2012 Okumura ..... H05H 1/34 438/798
2015/0069912 A1 * 3/2015 Valcore, Jr. ..... H01J 37/32926 315/111.21
2015/0114563 A1 * 4/2015 Hirano ..... H01J 37/32082 315/111.21
2015/0192613 A1 * 7/2015 Draaijer ..... H01R 13/6691 324/754.11
2015/0271906 A1 * 9/2015 Kamata ..... H02M 1/00 315/111.21
2015/0283640 A1 * 10/2015 Walker ..... B23K 10/006 219/130.01
2016/0234922 A1 * 8/2016 Tabata ..... H02M 1/32
2016/0307739 A1 * 10/2016 Lee ..... H01J 37/321
2017/0194746 A1 * 7/2017 Freer ..... G01R 31/52
2020/0118801 A1 * 4/2020 Jindo ..... H01J 37/3299
2021/0076480 A1 * 3/2021 Ikedo ..... H05H 1/34

FOREIGN PATENT DOCUMENTS

DE 4234267 A1 * 4/1993 ..... H05H 1/34
DE 4342651 A1 * 6/1994 ..... H01R 13/641
DE 4305541 A1 * 8/1994 ..... H05H 1/34
DE 19604249 A1 * 8/1996 ..... H01R 13/639
DE 102011080456 A1 * 2/2013 ..... B60L 11/1818
EP 1455423 A1 * 9/2004 ..... H01R 13/641
JP 54-146891 U 10/1979
JP 62-245162 A 10/1987
JP H05204459 A * 8/1993
JP H07302648 A * 11/1995
JP H08506922 A * 7/1996
JP H11348678 A * 12/1999
JP 2001-314009 A 11/2001
JP 2005251540 A * 9/2005 ..... H01R 13/641
JP 2009-301730 A 12/2009
JP WO2018185834 A1 * 10/2018
JP 2020035685 A * 3/2020
JP 2020123593 A * 8/2020 ..... G01R 31/1272
JP 2020123593 A5 * 8/2020
WO WO-2013034928 A1 * 3/2013 ..... H01R 13/453
WO WO-2018185834 A1 * 10/2018 ..... G01R 31/1272
WO WO-2018211585 A1 * 11/2018 ..... H01B 7/0045
WO WO-2021214876 A1 * 10/2021
WO WO-2021229633 A1 * 11/2021
WO WO-2022029967 A1 * 2/2022
WO WO-2022044068 A1 * 3/2022

* cited by examiner

PLASMA GENERATOR WITH CONNECTOR-CABLE DETECTOR

TECHNICAL FIELD

The present application relates to a plasma-generating device.

BACKGROUND ART

Patent literature 1 discloses a cable failure display device in which, for example, each three-phase cable has a shield (metallic shield) that is grounded and includes a current sensor that detects a ground fault current flowing through the shield to ground. According to the cable failure display device of patent literature 1, it is possible to detect that the cable is grounded when the ground fault current exceeds a predetermined value.

CITATION LIST

Patent Literature

Patent Literature 1: JP-A-2001-314009

BRIEF SUMMARY

Technical Problem

However, in a plasma generator, a voltage is applied to a pair of electrodes equipped on a head, electrical discharge is generated between the pair of electrodes, and the plasma generated from the head is applied to a target object. The head may include, for example, a connector or the like electrically connected to a pair of power cables for supplying power to the pair of electrodes, and the connector may be electrically disconnectable from the pair of power cables. In this case, if electric power is supplied to the pair of power cables in a state in which the connector of the head is not electrically connected to the pair of power cables, a short circuit or electrical discharge may occur from a terminal of one of the pair of power cables connected to the connector to nearby metal, and a current may flow. Nearby metal refers to, for example, a shield of the power cables, a terminal of the other of the pair of power cables, a housing of the device, or the like.

If a current flows from one terminal of one of the pair of power cables to a power cable shield, according to the configuration of patent literature 1, it can be detected by the current sensor that the connector of the head is not electronically connected to the pair of power cables. However, when an electric current flows through nearby metal other than the shield, according to the configuration of patent literature 1, it is not possible to detect whether the connector of the head and the pair of power cables are electrically connected to each other.

The present disclosure takes account of the above circumstances and an object thereof is to provide a plasma generator capable of detecting whether a connector of a head is electrically connected to a power cable.

Solution to Problem

Disclosed herein is a plasma generator including: a head including a connector provided with a terminal configured to supply electricity to electrodes that generate plasma by electrical discharge, and a first terminal and a second terminal that are connected to each other; a power cable configured to supply electricity to the terminal; a cable to transmit a signal to the first terminal; a first ground cable configured to ground the second terminal; and a detector configured to detect a signal current that flows in a path from the cable to the first ground cable in accordance with transmission of the signal.

Advantageous Effects

According to the present disclosure, since the detector detects the signal current when the connector and the cable and first ground cable are connected to each other, it is possible to provide a plasma generator capable of detecting whether the connector of the head and the power cable are electrically connected to each other.

DESCRIPTION OF EMBODIMENTS

Overall Configuration

Figure 1:
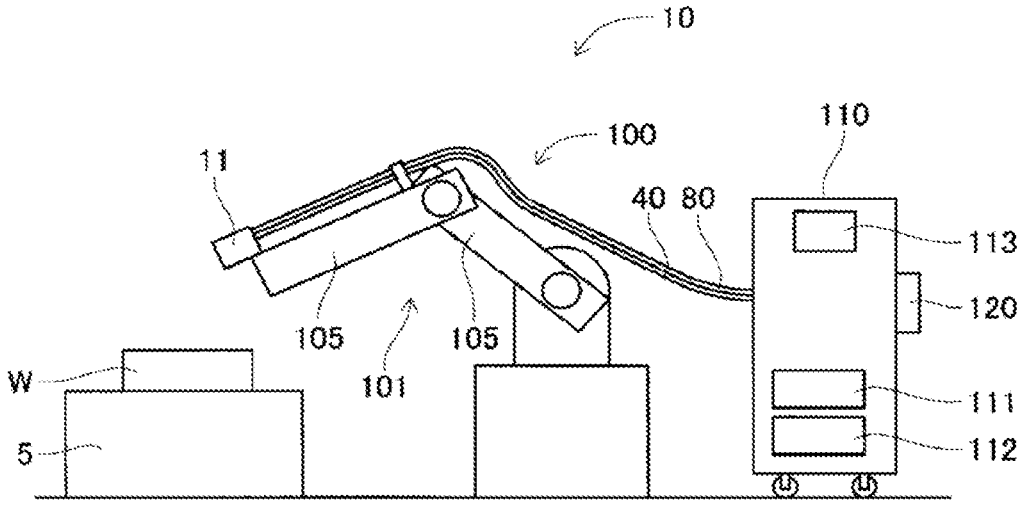
FIG. 1 is a schematic diagram showing the configuration of a plasma generator attached to an industrial robot.

Plasma generator 10 is provided with plasma head 11, control device 110, cable harness 40, gas tube 80, detection module 120, and the like. Plasma generator 10 transmits power from control device 110 to plasma head 11 via cable harness 40, supplies processing gas via gas tube 80, and causes plasma to be emitted from plasma head 11. Plasma head 11 is attached to the tip of robot arm 101 of industrial robot 100. Cable harness 40 and gas tube 80 are mounted along robot arm 101. Robot arm 101 is a multi-joint robot in which two arm sections, 105 and 105, are connected in one direction. Industrial robot 100 drives robot arm 101 to apply plasma onto workpiece W supported by workpiece table 5. As described later, cable harness 40 includes first power cable 50, second power cable 51, cable 52, and first ground cable 53. Gas tube 80 has a first gas tube and a second gas tube, which are not shown. Control device 110 includes first processing gas supply device 111 and second processing gas supply device 112. First processing gas supply device 111 supplies an inert gas containing nitrogen or the like as a processing gas. Second processing gas supply device 112 supplies an active gas containing dry air or the like as a processing gas. Control device 110 also includes touchscreen panel 113. Touchscreen panel 113 displays various setting screens, operation states of the device, and the like.

Configuration of Plasma Head

Figure 2:
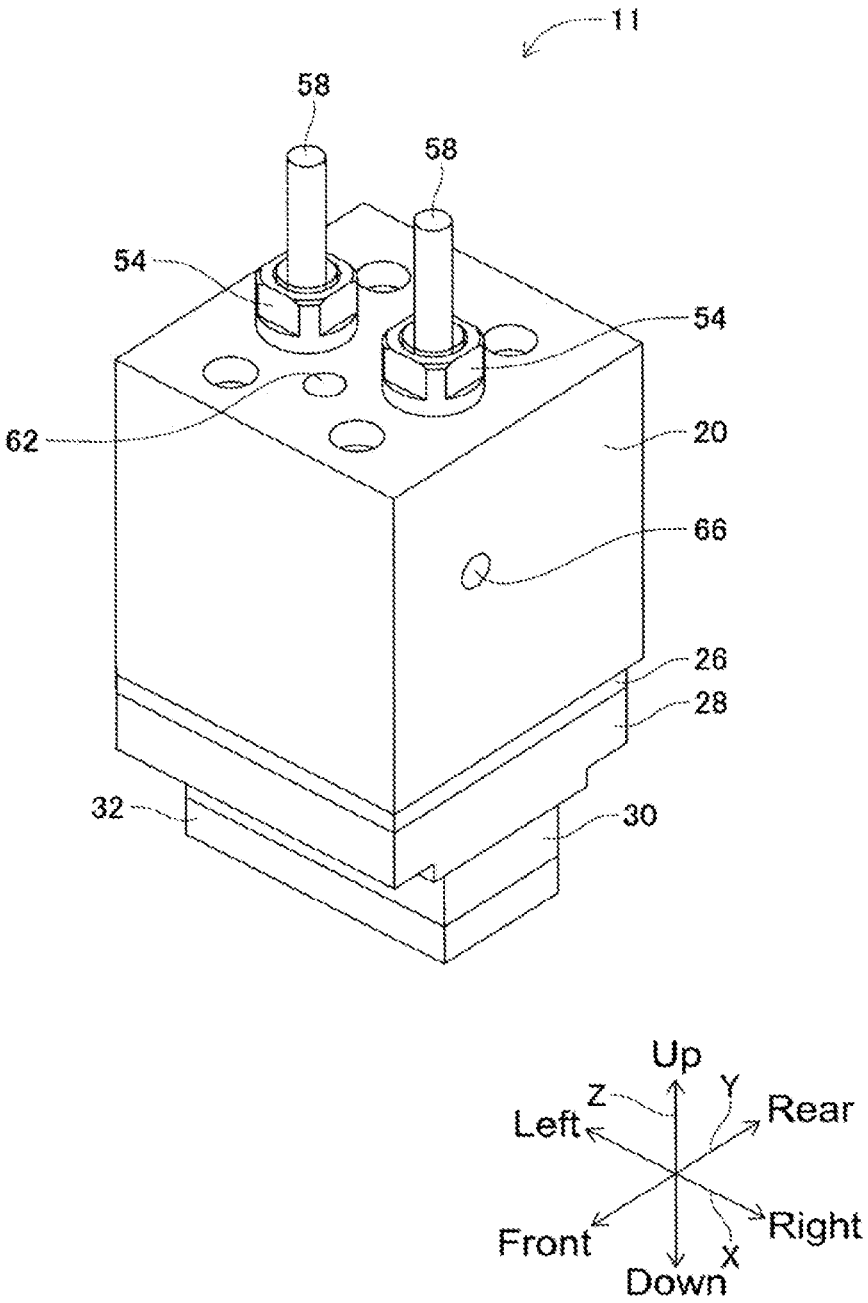
FIG. 2 is a perspective view of a plasma head.
Figure 3:
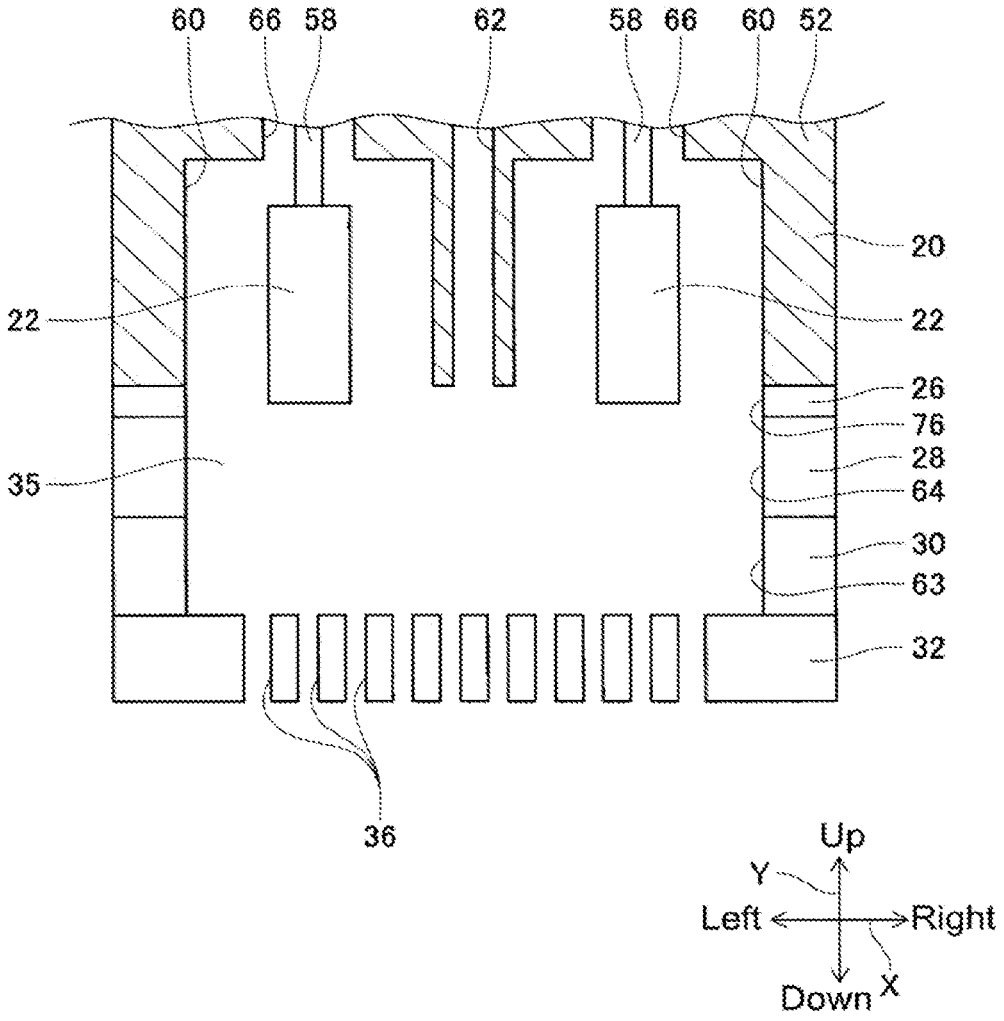
FIG. 3 is a cross-sectional view showing the internal structure of the plasma head.

Next, the configuration of the plasma head 11 will be described with reference to FIGS. 2 and 3. As shown in FIG. 2, plasma head 11 includes main body block 20, pair of electrodes 22 (see FIG. 3), buffer member 26, first connecting block 28, reaction chamber block 30, and second connecting block 32. In the following description, directions are as shown in FIG. 2.

Holes (not shown) penetrating in the vertical direction are formed in the upper surface of main body block 20, and cylindrical upper holders 54 and 54 are attached to the penetrating holes. Bar-shaped conductive sections 58 and 58 are inserted into upper holders 54 and 54, and are fixedly held by upper holders 54 and 54. Conductive sections 58 and 58 are respectively electrically connected to first power cable 50 and second power cable 51. Pair of electrodes 22 are attached to the lower end sections of conductive sections 58 and 58. The pair of electrodes 22 are generally rod-shaped. In main body block 20, an opening of first gas flow path 62 penetrating in the vertical direction is formed at a position on the center line along the Y axis direction of the upper surface of main body block 20. Further, two openings of second gas flow path 66 are formed in the left and right surfaces of main body block 20. The first gas tube and the second gas tube are respectively physically connected to first gas flow path 62 and second gas flow path 66 (the connections are not shown in the figure).

Buffer member 26 has a generally plate shape and is formed of a material made of silicone resin. First connecting block 28, reaction chamber block 30, and second connecting block 32 are generally thick plates and formed of a ceramic material.

Next, the internal structure of plasma head 11 will be described with reference to FIG. 3. A pair of cylindrical recesses 60 are formed on the lower surface of main body block 20. Further, first gas flow path 62 and two second gas flow paths 66 are formed inside main body block 20. First gas flow path 62 opens between the pair of cylindrical recesses 60, and the two second gas flow paths 66 open inside the pair of cylindrical recesses 60. Second gas flow paths 66 extend from the left and right surfaces of main body block 20 toward the center of main body block 20 by a predetermined distance along the X axis direction, and then are bent downward. Further, first gas flow path 62 extends downward from the upper surface of main body block 20 by a predetermined distance along the Z-axis direction, then bends backward, and further bends downward.

Insertion section 76 connected with cylindrical recess 60 is formed in buffer member 26. Insertion section 64 connected with insertion section 76 is formed in first connecting block 28. Insertion section 63 connected with insertion section 64 is formed in reaction chamber block 30. Cylindrical recess 60, insertion section 76, insertion section 64, and insertion section 63 of main body block 20 are connected with each other, and the internal space therein is reaction chamber 35. Multiple connecting holes 36 are formed penetrating in the vertical direction in second connecting block 32. The multiple connecting holes 36 are formed in the central portion in the Y direction so as to be aligned in the X direction.

Plasma Application

Next, plasma generation in plasma generator 10 will be described. A mixed gas of an inert gas such as nitrogen and dry air is supplied as a processing gas to first gas flow path 62. The gas supplied to first gas flow path 62 is supplied to reaction chamber 35. In addition, an inert gas such as nitrogen is supplied to second gas flow path 66 as a processing gas. The inert gas supplied to second gas flow path 66 is supplied to reaction chamber 35. A voltage is applied to the pair of electrodes 22. As a result, a quasi-arc discharge occurs between the pair of electrodes 22, and a current flows. The processing gas is converted into a plasma by the pseudo-arc discharge. Note that, a pseudo-arc discharge is a method of discharging while limiting the current by a plasma power supply so that a large current does not flow as with a normal arc discharge. The plasma generated in reaction chamber 35 is ejected through the multiple connecting holes 36 of second connecting block 32, such that plasma is applied to workpiece W.

Control System

Figure 4:
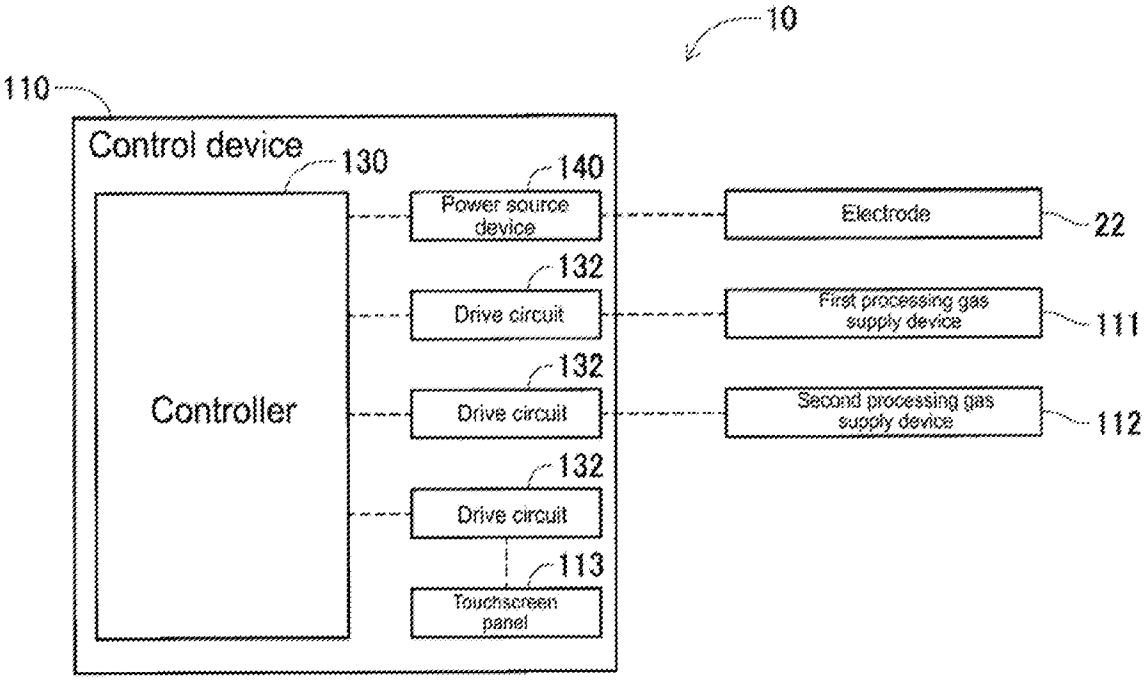
FIG. 4 is a block diagram showing a control system of the plasma generator.

Next, the control system of plasma generator 10 will be described with reference to FIG. 4. In addition to the above-described configuration, control device 110 includes controller 130, power source device 140, and multiple drive circuits 132. The multiple drive circuits 132 are connected to first processing gas supply device 111, second processing gas supply device 112, and touchscreen panel 113. Controller 130 includes a CPU, ROM, RAM, and the like, is configured mainly from a computer, and is connected to the multiple drive circuits 132 and power source device 140. Controller 130 controls power source device 140, first processing gas supply device 111, second processing gas supply device 112, touchscreen panel 113, and the like.

Connections of Plasma Head 11

Figure 5:
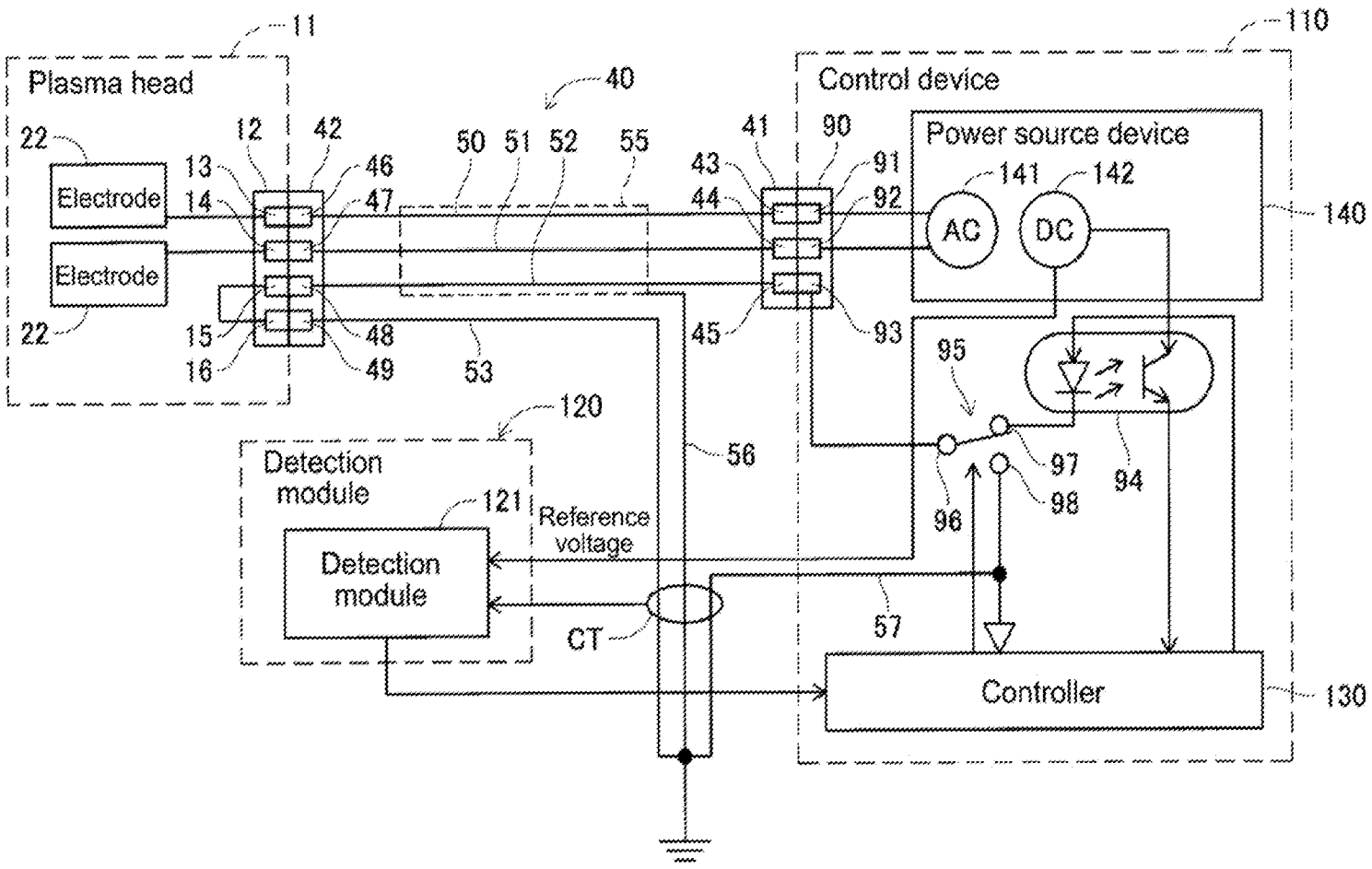
FIG. 5 is a block diagram showing electrical connections between the plasma head and the control device.

As shown in FIG. 5, plasma head 11 includes a housing, which is not shown, and connector 12 is installed on the outer surface of the housing. Connector 12 has terminals 13 to 16. Terminals 13 and 14 are a pair of terminals electrically connected to pair of electrodes 22 and 22. Terminal 15 and terminal 16 are connected to each other inside the head 11. Cable harnesses 40 includes connectors 41 and 42, first power cable 50, second power cable 51, cable 52, and first ground cable 53. First power cable 50 and second power cable 51 are a pair of power cables for supplying electricity to terminals 13 and 14. Cable 52 is a cable for transmitting pulse signals, which will be described later, to terminal 15. Connector 41 has terminals 43 to 45. Connector 42 has terminals 46 to 49. Each of first power cable 50, second power cable 51, cable 52, and first ground cable 53 has an insulating body coated on an electric wire. Further, one end of each of first power cable 50, second power cable 51, and cable 52 is connected to the respective terminals 43 to 45, and the other end is connected to the respective terminals 46 to 48. One end of first ground cable 53 is connected to terminal 49, and the other end is grounded. First power cable 50, and second power cable 51 and cable 52 are shielded by a mesh-like conductive shield member 55. Shield member 55 is grounded at second ground cable 56 which is covered with an insulating body.

Control device 110 includes photocoupler 94 and relay 95 in addition to the above-described configuration. Further, control device 110 includes a housing (not shown), and connector 90 is installed on the outer surface of the housing. Connector 90 has terminals 91 to 93. Power source device 140 supplied from a commercial power supply (not shown) includes AC power source 141 and DC power source 142. AC power source 141 supplies AC power to terminals 91 and 92.

Relay 95 has output terminal 96, first input terminal 97, and second input terminal 98, and in response to signals output from controller 130, the connection with output terminal 96 is switched from second input terminal 98 to first input terminal 97. DC power source 142 supplies DC voltage to the anode terminal of the phototransistor of photocoupler 94. The cathode terminal of the phototransistor of photocoupler 94 and the anode terminal of a light-emitting diode are electrically connected to controller 130. The cathode terminal of the light-emitting diode of photocoupler 94 is connected to first input terminal 97 of relay 95. Second input terminal 98 of relay 95 is grounded via third ground cable 57 which is covered with an insulating body. Further, the grounding voltages of power source device 140 and controller 130 included in control device 110 are grounded via third ground cable 57. Output terminal 96 of relay 95 is electrically connected to output terminal 93 of connector 90.

Connector 90 of control device 110 and connector 41 of cable harness 40 are connected so that terminals 91 to 93 are connected to terminals 43 to 45, respectively. Connector 12 of head 11 and connector 42 of cable harness 40 are connected so that terminals 13 to 16 are connected to terminals 46 to 49, respectively.

Detection module 120 includes current transformer CT and comparison circuit 121. First ground cable 53, second ground cable 56, and third ground cable 57 are inserted through the through-core of current transformer CT. Current transformer CT outputs a detected voltage corresponding to the current flowing through first ground cable 53, second ground cable 56, and third ground cable 57 to comparison circuit 121. DC power supply 142 supplies a reference voltage to comparison circuit 121. When the detected voltage becomes equal to or higher than the reference voltage, the comparison circuit 121 outputs a signal indicating that the detected voltage has become equal to or higher than the reference voltage to controller 130.

As shown in FIG. 1, cable harness 40 is attached to robot arm 101 of industrial robot 100. The length of cable harnesses 40 is, for example, about 5 m. Further, plasma head 11 may be removed from industrial robot 100 and disconnected from cable harnesses 40, for example, for maintenance purposes. Thereafter, when plasma head 11 is attached to industrial robot 100, the operator may forget to connect plasma head 11 to cable harnesses 40. For example, prior to starting the power supply from power source device 140 to plasma head 11, controller 130 performs processing to check whether plasma head 11 is connected to cable harnesses 40.

For example, when controller 130 receives a command to start emitting plasma, it outputs a signal to relay 95 to switch the connection of output terminal 96 from second input terminal 98 to first input terminal 97 in order to check whether plasma head 11 is connected to cable harnesses 40. As a result, as shown in FIG. 5, output terminal 96 and first input terminal 97 are connected to each other. In addition, a pulse signal is output to the light emitting diode of photocoupler 94. If cable harness 40 and plasma head 11 are electronically connected, a signal current in response to the pulse signal will flow to the earth via relay 95, cable 52, terminal 48, terminal 15, terminal 16, and first ground cable 53. As a result, an on signal is outputted from photocoupler 94 to controller 130. When the on signal is inputted from photocoupler 94, controller 130 causes touchscreen panel 113 to display information indicating that there is a connection, for example, and starts supplying power to power source device 140. On the other hand, if cable harness 40 and plasma head 11 are not electrically connected to each other, a signal current corresponding to the pulse signal does not flow, such that an on signal is not outputted from photocoupler 94 to controller 130. If an on signal is not inputted from photocoupler 94, controller 130 displays, for example, information indicating that there is no connection on touchscreen panel 113. As a result, the operator can recognize that plasma head 11 and cable harnesses 40 are not connected to each other.

Note that, when plasma is emitted, controller 130 does not output a signal for switching the connection with output terminal 96 from second input terminal 98 to first input terminal 97 to relay 95. Therefore, in relay 95, output terminal 96 and second input terminal 98 are connected to each other, and cable 52 is grounded via third ground cable 57.

Note that, cable harness 40 is attached to robot arm 101 of industrial robot 100. As a result, cable harness 40 may be stressed and damaged by bending, resting, pulling, or the like, due to movement of robot arm 101. For example, if at least one of first power cable 50 and second power cable 51 is damaged and a short circuit or electrical discharge occurs with grounded shield member 55, current flows through second ground cable 56. In addition, for example, if at least one of first power cable 50 and second power cable 51 and at least one of cable 52 and first ground cable 53 is damaged, and a short circuit or electrical discharge occurs between at least one of first power cable 50 and second power cable 51 and the ground, a current flows through at least one of cable 52 and first ground cable 53. When a current flows to cable 52, current flows to third ground cable 57 via relay 95. Due to the short circuit or electrical discharge, current flows through at least one of first ground cable 53, second ground cable 56, and third ground cable 57, and if the detected voltage of current transformer CT becomes equal to or higher than the reference voltage, comparison circuit 121 outputs a signal indicating that the detected voltage has become equal to or higher than the reference voltage to controller 130. When a signal indicating that the detected voltage is equal to or higher than the reference voltage is inputted, controller 130 displays, for example, a message informing about the leakage on touchscreen panel 113.

Here, plasma generator 10 is an example of a plasma generator. Electrodes 22, 22 are an example of an electrode and a pair of electrodes, terminals 13, 14 are an example of a terminal and a pair of terminals, terminal 15 is an example of a first terminal, and terminal 16 is an example of a second terminal. Connector 12 is an example of the connector, and plasma head 11 is an example of a plasma head. First power cable 50 and second power cable 51 are examples of a power cable and a pair of power cables. Cable 52 is an example of a cable, first ground cable 53 is an example of a first ground cable, and photocoupler 94 is an example of a detector and a photocoupler. The light emitting diode of photocoupler 94 is an example of a light emitting element. Controller 130 is an example of a signal output device. Relay 95 is an example of a relay, output terminal 96 is an example of an output terminal, first input terminal 97 is an example of a first input terminal, and second input terminal 98 is an example of a second input terminal. Third ground cable 57 is an example of a third ground cable, and second ground cable 56 is an example of a second ground cable. Touchscreen panel 113 is an example of a reporting section.

According to the first embodiment described above, the following effects are obtained.

Plasma generator 10 includes: plasma head 11 provided with connector 12; cable harness 40; and photocoupler 94. Connector 12 has terminals 13 and 14 for supplying power to electrodes 22 and 22 that generate plasma by electrical discharge, and terminals 15 and 16 that are connected to each other. Cable harness 40 has first power cable 50 and second power cable 51 for supplying power to terminals 13 and 14, cable 52 for transmitting a pulse signal to terminal 15, and first ground cable 53 for grounding terminal 16. Photocoupler 94 detects a signal current flowing in a path from cable 52 to first ground cable 53 in accordance with the transmission of the pulse signal.

When connector 12 of plasma head 11 is electrically connected to cable harness 40, a signal current corresponding to the pulse signal flows from controller 130 to the ground via photocoupler 94, relay 95, cable 52, terminal 15, terminal 16, and first ground cable 53. On the other hand, when connector 12 of plasma head 11 is not electrically connected to cable harness 40, the signal current corresponding to the pulse signal does not flow. That is, detection of the signal current by photocoupler 94 occurs when connector 12 of plasma head 11 and cable harness 40 are electrically connected to each other. Plasma generator 10 can detect whether connector 12 of plasma head 11 is electrically connected to first power cable 50 and second power cable 51 according to whether photocoupler 94 detects the signal current.

Plasma generator 10 also includes relay 95 interposed between controller 130 and cable 52. Relay 95 has first input terminal 97 connected to controller 130, second input terminal 98 connected to ground, and output terminal 96 connected to cable 52. Controller 130, for example before plasma generation, outputs a pulse signal to photocoupler 94, and outputs a signal to relay 95 to switch the connection with output terminal 96 to first input terminal 97. Relay 95 switches the connection with output terminal 96 from second input terminal 98 to first input terminal 97 in response to the transmission of the pulse signal. In this manner, plasma generator 10 connects output terminal 96 of relay 95 to first input terminal 97 when detecting whether connector 12 of plasma head 11 is electrically connected to cable harness 40. Also, plasma generator 10 connects output terminal 96 of relay 95 to second input terminal 98 when plasma is generated by supplying electricity to pair of electrodes 22 and 22. Thus, cable 52 is grounded by a path via relay 95 while plasma is generated.

Further, plasma generator 10 includes: first ground cable 53 for grounding terminal 16; third ground cable 57 for grounding second input terminal 98; second ground cable 56 for grounding shield member 55; and current transformer CT. Current transformer CT detects a signal current flowing through first ground cable 53, and current flowing through second ground cable 56 and third ground cable 57. When at least one of first power cable 50 and second power cable 51 is damaged during plasma generation by supplying power to pair of electrodes 22 and 22, a current may flow through second ground cable 56 due to discharge or a short circuit with shield member 55. Also, when at least one of first power cable 50 and second power cable 51 and at least one of cable 52 and first ground cable 53 is damaged, a short circuit or discharge occurs between at least one of first power cable 50 and second power cable 51 and at least one of cable 52 and first ground cable 53, and a current may flow to the ground through at least one of cable 52 and first ground cable 53. In such cases, when a current due to a short circuit or discharge flows through at least one of first ground cable 53, second ground cable 56, or third ground cable 57, and the detection voltage becomes equal to or higher than the reference voltage, comparison circuit 121 outputs a signal indicating that the detection voltage has become equal to or higher than the reference voltage to controller 130. In this manner, the connection of relay 95 to output terminal 96 is switched, and the current transformer CT can detect whether connector 12 of plasma head 11 is electrically connected to first power cable 50 and second power cable 51, as well as the leakage of the ground due to the damage of first power cable 50 and second power cable 51.

In addition, plasma generator 10 includes touchscreen panel 113 for reporting that connector 12 is connected in response to photocoupler 94 detecting a signaling current. Thus, the operator can recognize that connector 12 is not connected.

Meanwhile, it goes without saying that the present disclosure is not limited to above-mentioned embodiments and may be improved and modified in various ways without departing from the scope of the disclosure.

For example, although a configuration including relay 95 has been described above, a configuration not including relay 95 may be used. In this case, during plasma generation, the output terminal for the pulse signal of controller 130 may be high-impedance, pull-down, or the like. Further, although the configuration including a single-pole double-throw relay 95 has been described above, a configuration including a single-pole single-throw relay may be used. More specifically, during plasma generation, the contact point of the relay is opened, and the electrical connection between photocoupler 94 and terminal 93 is cut. Further, when detecting whether connector 12 of plasma head 11 is electrically connected to cable harness 40, the contacts of the relay are closed.

Also, in descriptions above, photocoupler 94 detects whether connector 12 of plasma head 11 is electrically connected to cable harness 40, but the configuration may be such that detection is performed by current transformer CT. More specifically, similarly to above, a pulse signal may be transmitted to cable 52, and whether a signal current flows to first ground cable 53 may be detected by current transformer CT.

Further, in descriptions above, photocoupler 94 is given as an example of a detector, but the detector is not limited to photocoupler 94. For example, a shunt resistor or the like may be used to detect a signal current. In addition, although photocoupler 94 has been described as being connected between controller 130 and relay 95, the position is not limited to this, for example, it may be connected between relay 95 and terminal 93.

Also, in descriptions above, the pulse signal is given as an example of a signal, but the signal is not limited to a pulse signal. For example, the signal may be a constant voltage signal. In this case, instead of controller 130, the signal may be outputted from power source device 140.

Also, in descriptions above, although first ground cable 53 is not shielded by shield member 55, it may be shielded by shield member 55.

Although touchscreen panel 113 is given as an example of a reporting section, the configuration is not limited thereto. The reporting section may be, for example, an indicator light such as LEDs, a speaker, or the like.

REFERENCE SIGNS LIST

10: plasma generator;
11: plasma head;
12: connector;
13, 14, 15, 16: terminal;
22: electrode;
50: first power cable;
51: second power cable;
52: cable;
53: first ground cable;
56: second ground cable;
57: third ground cable;
94: photocoupler;
95: relay;
96: output terminal;
97: first input terminal;
98: second input terminal;
113: touchscreen panel;
130: controller;
CT: current transformer

The invention claimed is:

1. A plasma generator, comprising:

a head including a connector, the connector including a power terminal configured to supply electricity to an electrode that generates plasma by electrical discharge, and a first signal terminal and a second signal terminal that are connected to each other inside the head;

a power cable configured to supply electricity to the power terminal;

a cable to transmit a signal to the first signal terminal;

a first ground cable configured to ground the second signal terminal; and a detector configured to detect a signal current that flows in a path from the cable to the first ground cable via the first signal terminal and the second signal terminal in accordance with transmission of the signal.

2. The plasma generator according to claim 1, wherein the detector is a photocoupler having a light emitter interposed in the path.

3. The plasma generator according to claim 1, further comprising:

a relay interposed between an output device configured to output the signal and the cable, wherein the relay includes a first input terminal connected to the output device of the signal, a second input terminal that is grounded, and an output terminal connected to the cable, further wherein a connection to the output terminal is switched from the second input terminal to the first input terminal in response to transmission of the signal.

4. The plasma generator according to claim 3, further comprising:

a second ground cable that grounds the second input terminal, and a third ground cable that grounds a shield member configured to shield the power cable and the cable, wherein the detector is a current transformer, and the current transformer is configured to detect the signal current flowing in the first ground cable and a current flowing in the second ground cable and in the third ground cable.

5. The plasma generator according to claim 1, further comprising:

a reporting section configured to report a fact that the connector is connected in accordance with the detector detecting the signal current.

6. The plasma generator according to claim 1, further comprising:

a pair of the electrode, the power terminal, and the power cable.

* * * * *